US005564338A

United States Patent [19]

Branas

[11] Patent Number: 5,564,338

[45] Date of Patent: Oct. 15, 1996

[54] DEVICE FOR WASHING INKING ELEMENTS OF A ROTARY PRINTING MACHINE

[75] Inventor: Juan Branas, Vouvry, Switzerland

[73] Assignee: Bobst SA, Lausanne, Switzerland

[21] Appl. No.: 491,162

[22] Filed: Jun. 16, 1995

[30] Foreign Application Priority Data

Jun. 17, 1994 [CH] Switzerland ..... 01916/94

[51] Int. Cl.[6] ..... B41F 35/00

[52] U.S. Cl. ..... 101/424; 101/425

[58] Field of Search ..... 101/424, 425, 101/423, 424.1, 424.2, 416.1

[56] References Cited

U.S. PATENT DOCUMENTS

| | | | |
|---|---|---|---|
| 4,271,347 | 6/1981 | Svenson | 101/424.1 |
| 4,686,902 | 8/1987 | Allain et al. | 101/424 |
| 5,003,876 | 4/1991 | Harrison et al. | 101/425 |
| 5,209,164 | 5/1993 | Durrnagel et al. | 101/425 |
| 5,213,044 | 5/1993 | Elia et al. | 101/424 |
| 5,259,313 | 11/1993 | Gibson et al. | 101/425 |
| 5,379,696 | 1/1995 | Boehme et al. | 101/424 |

FOREIGN PATENT DOCUMENTS

| | | | |
|---|---|---|---|
| 2587274 | 3/1987 | France | 101/424.2 |

*Primary Examiner*—Edgar S. Burr
*Assistant Examiner*—Anthony H. Nguyen
*Attorney, Agent, or Firm*—Hill, Steadman & Simpson

[57] ABSTRACT

A device for washing inking elements of a rotary printing machine, particularly for washing the ink-transferring canvas cylinder, the ink recovery container, the doctor blade chamber and various conduits of the inking elements which are first washed by an arrangement for conducting a washing fluid through the conduits, comprises an arrangement mounted in a sub-frame having a distributor provided with nozzles, the distributor being mounted for pivotable movement and being shiftable transversely between the two sides of the sub-frames to provide a to-and-fro washing of the doctor blade chamber and recovery container. The angular position of the distributor is changed at the end of each stroke by the nozzles contacting a stop provided in the sub-frame and the transverse to-and-fro motion is preferably obtained by the distributor being connected to a piston of a linear pneumatic cylinder which is mounted in the subframe.

5 Claims, 2 Drawing Sheets

DEVICE FOR WASHING INKING ELEMENTS OF A ROTARY PRINTING MACHINE

BACKGROUND OF THE INVENTION

The present invention is directed to a device for washing inking elements of a rotary printing machine, specifically for washing the ink-transferring canvas cylinder, the ink fountain and doctor blade chambers and various conduits of the inking elements.

It is necessary to wash the printing elements of the printing arrangement for a rotary printing machine when changing colors of the inks. Otherwise, residues of a previously-used ink would contaminate the new color.

At present, the washing of the printing elements of a rotary printing machine is achieved by having water circulate in the conduits of the inking circuit and in the doctor blade chamber by means of the ink pump or of nozzles inside the doctor blade chamber, which is well-known to a man skilled in the art. This washing operation will wash all inking elements as well as the ink-transferring canvas cylinder. However, various of these inking elements, particularly the doctor blade chamber, receive ink splashings on their outer parts which will not be removed with this washing method. It will then be necessary to wash them independently from the washing with the water circulating in the conduits of the inking circuit. This washing operation can only be achieved manually and takes a considerable amount of time, due to the complexity of the outer shapes of the inking elements. This state of art comes from usual practice applied by the constructors of the rotary printing machine and appearing on its own catalogs and prospectuses of these constructors.

SUMMARY OF THE INVENTION

The object of the present invention consists in providing a washing device which will simplify the cleaning operation and eliminate every manual washing and cleaning of the printing elements of the rotary printing machine.

To accomplish this goal, the present invention is directed to a device for washing and cleaning inking elements of a rotary printing machine including the washing of the ink-transferring cylinder, the ink recovery container, the doctor blade chamber and the various conduits of the inking elements, which are washed by a washing fluid passing through the various conduits of the inking elements. The device includes a washing means fitted between two lateral walls and consisting of a distributor provided with nozzles, said distributor being mounted to pivot through an angle between a first and second position, means for shifting the distributor laterally between the two walls with the movement to and fro along the inking elements to be washed, and the angular position of the distributor being shifted every time the strap of the mounting means reaches an end of a lateral stroke.

Other advantages and features of the invention will be readily apparent from the following description of the preferred embodiment, the drawings and claims.

DESCRIPTION OF THE PREFERRED EMBODIMENTS

Figure 1:
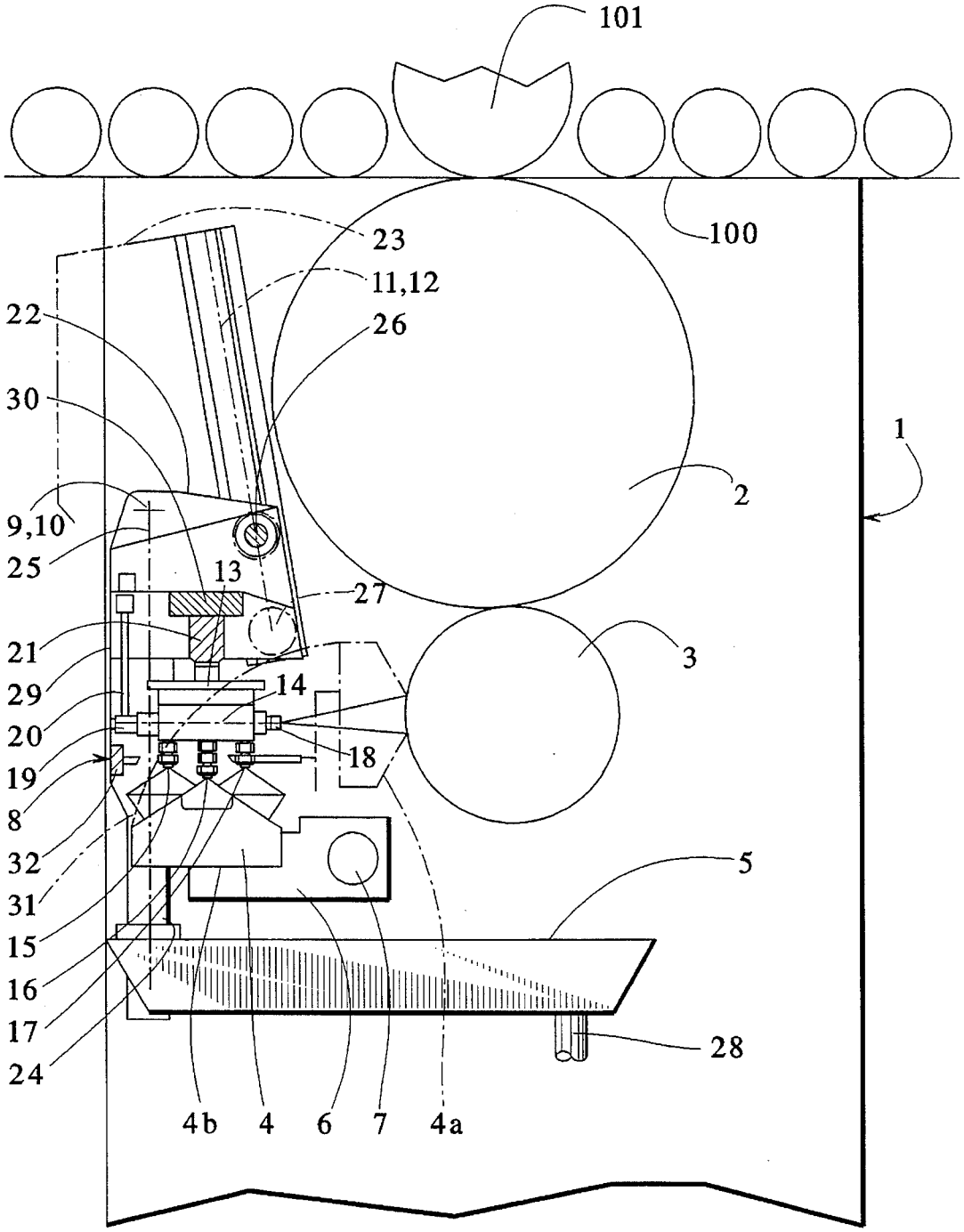
FIG. 1 is a partial cut-away view of an inking station of a rotary printing machine.

The principles of the present invention are particularly useful when incorporated in an inking station, generally indicated at 1 in FIG. 1, for a rotary flexographic printing machine which includes a plate cylinder 2 in which ink is applied by means of a canvas ink-transferring cylinder 3 of a "Anilox"-type device. The cylinder 2 transfers the ink to a sheet 100 which passes between a printing cylinder 2 and a second cylinder 101.

A doctor blade chamber 4 is mounted by a lever 6 at each end on an axle 7 and can be pivoted or rotated on the axle 7 from the illustrated position **4*b* to a position 4*a* shown in chain lines with the doctor blade chamber in contact with the ink-transferring cylinder 3. The position 4*a* is a position for a printing phase, while the position 4*b* is for a washing phase. In the printing phase, ink is provided to the doctor blade chamber 4 by means of a conduit connected to a pump, both of which are not represented and which are immersed in an ink fountain, generally located outside of the inking station 1**.

The washing device of the present invention is generally indicated at 8 in FIG. 1 and is mounted between two lateral plates 9 and 10 which form a sub-frame that is guided to move along grooves or tracks 11 and 12 provided on the side wall of the inking station. The sub-frame includes a crossbar 30 that extends between the plates or members 9 and 10. The washing device 8 includes a strap, such as a U-shaped member 13, having arms which pivotably support a distributor 14 which is provided with four nozzles 15, 16, 17 and 18. In the illustrated embodiment and for the reasons of function efficiency of the washing device 8, the central nozzle 16 is longer than the two side nozzles 15 and 17. The distributor 14 is mounted to be pivoted in the strap between one angular offset position shown in FIG. 2 which is oriented along a line 109 to an angular position extending by a similar amount on the other side of a vertical plane along a line 110. A resistance to the pivoting of the distributor 14 is obtained by tightening the latter between the arms of the strap or member 13, which is made of plastic material. The supply of a washing fluid is achieved through a connection 19 located at one end of the distributor and by a flexible conduit 20. The washing fluid may consist of water under pressure taken from an outside main, whose pressure will range between two and four bars. It is also possible to use a washing fluid taken from a source, such as a tank, by means of a pump. In the use of a tank, the washing fluid can be a mixture of water and detergent.

The strap 13 is attached to translation means for shifting which includes a linear pneumatic cylinder 21, which is fitted between the two lateral side walls 9 and 10 so that the strap moves along the crossbar 30. The strap 13 may be connected to a piston in the cylinder 21 by a magnetic coupling through the wall of the cylinder 21. The washing device 8 can be shifted along the tracks 11 and 12 from the illustrated position 22 to an upper withdrawn position illustrated by chain lines 23. This shifting is accomplished by a pneumatic cylinder 24 which is mounted on the frame of the inking station and has a piston rod 25 which is connected to each of the lateral side walls 9 and 10.

The nozzles 15, 16 and 17 are directed downward toward the doctor blade chamber 4 when the doctor blade chamber is in the position **4*b*, whereas the nozzle 18, which is located on the opposite end to the washing fluid side, is directed toward the ink-transferring cylinder 3**, which may be a canvas cylinder.

During its shifting from the position 22 to the position 23, the washing device 3 is guided by rollers 26 and 27, which are engaged in the grooves or tracks 11 and 12. During the washing phase, the washing fluid is gathered in a recovery container or trough 5 and removed through a duct or conduit 28 toward a filtering installation where it is filtered prior to being discharged into a drain. On the part opposite the doctor blade chamber in the position **4*b*, the washing device is closed by means of a protective sheet metal hood 29, which extends between the two side walls 9 and 10** of the sub-frame.

Figure 2:
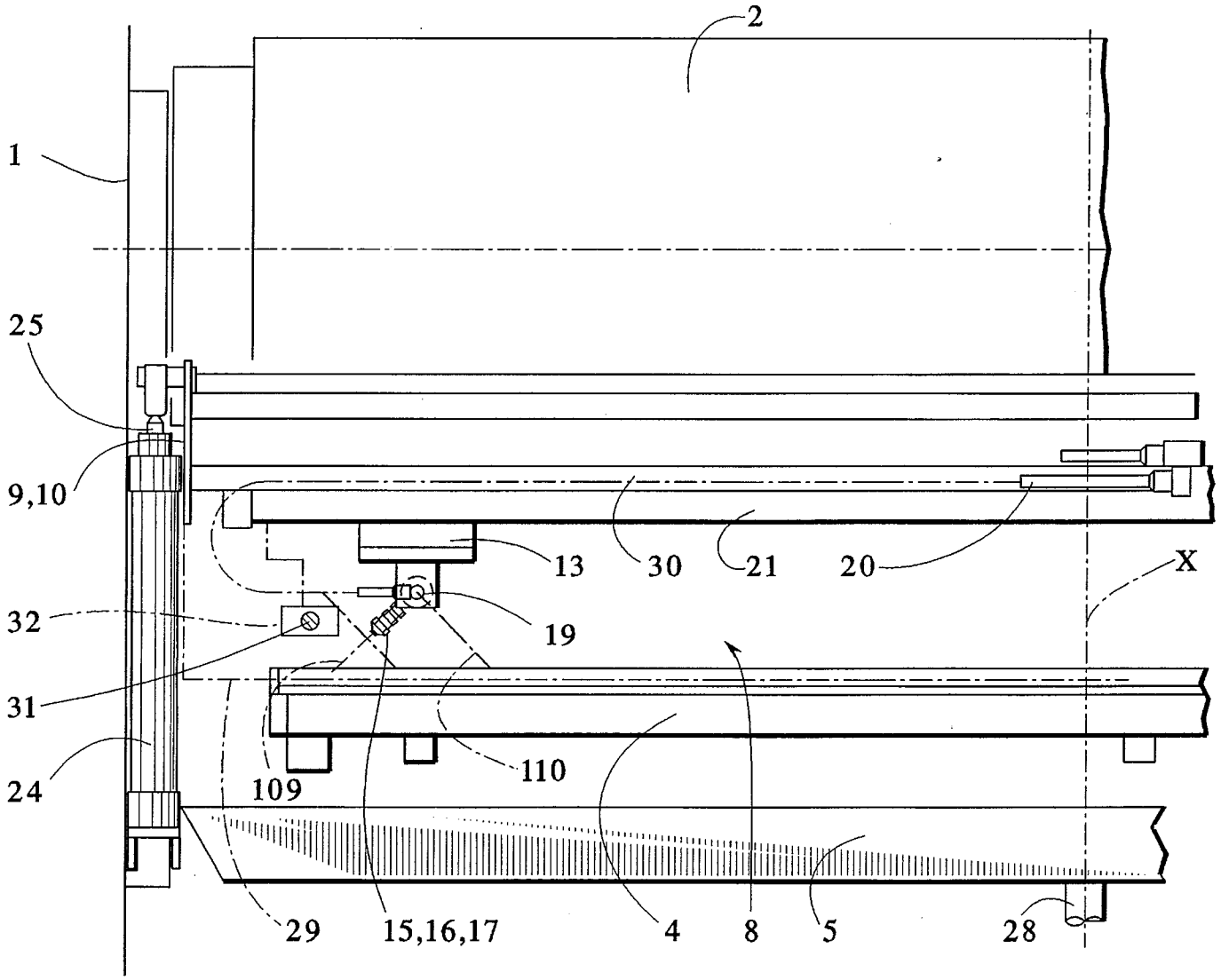
FIG. 2 is a partial side view of the device of FIG. 1.

FIG. 2, is a side view of the arrangement which only shows one-half or the left side of the device, although the right side is a mirror image. As illustrated, at each end of the translation means, which is illustrated as a linear pneumatic cylinder 21, is a stop 31 which is attached to a base which is, in turn, attached to the crossbar 30. During a washing operation, as the translation means brings the strap 13 with the nozzles 15, 16 and 17 toward the stop 31 of FIG. 2, the nozzles 15, 16 and 17 will strike the stop 31 and, therefore, be shifted from the position extending along line 109, as illustrated in FIG. 2, to a position extending along a line 110, which is at an opposite angle but directed to the right, as illustrated in FIG. 2, instead of to the left.

The washing operation for the inking elements is achieved in the following way. First of all, the inking circuit which brings the ink toward the doctor blade chamber 4 is rinsed very conventionally by injecting washing fluids into the inking pump. This washing fluid will rinse the insides of the doctor blade chamber 4 while it is in the position **4*a* and also wash the ink-transferring canvas cylinder 3. When this is completed, the supply of washing fluid in the inking circuit will be stopped and the pneumatic cylinder 24 will be actuated so that the washing device 8 will pass from a position 22 to the upper position 23. Then, the doctor blade chamber 4 is pivoted from the position 4*a* to a position 4*b* and, subsequently, the pneumatic cylinder 24 is actuated again so as to reposition the washing device in position 22**.

With the washing device in the position 22 and the doctor blade in the position **4*b*, washing fluid will be injected into the distributor 14 to be sprayed through the nozzles 15, 16 and 17 onto the doctor blade chamber 4 and through nozzle 19 to be sprayed onto the transferring-ink canvas cylinder 3. The translation means, such as the actuator, is then actuated to transport or shift the distributor along the whole length of the doctor blade chamber 4. When it reaches the other end, the nozzles will be switched from one position to the other position and then it will be transported in the opposite direction until it reaches an end of the stroke. Thus, the spray device moves back and forth along the entire length of the doctor blade chamber with the nozzles being switched between their two angular orientations when they contact the stops at the each end of the travel. The washing fluid will, therefore, be projected onto the inside and over the whole surface of the doctor blade chamber according to two different angles, which action will provide a perfect washing of all surfaces of the doctor blade chamber 4, which will have been soiled by ink splashing. Moreover, during the movement to and fro of the washing device 8, the nozzles will spray washing fluid on the ink-transferring cylinder 3**, which will be rotated during this washing phase.

When the washing operation is finished, compressed air is then introduced into the supply ducts of the washing device 8, which will dry the inking elements and, at the same time, remove any washing fluid residue from the nozzles 15–18 as well as to prevent any scaling to occur. When the drying of the ink elements is finished, the washing device will be raised to the position 23 and the doctor blade chamber 4 will then be brought back to the position **4*a* which corresponds to the new printing phase. Then, the washing device will be brought back to the position 22. In order to improve the washing, washing fluids can be reintroduced in the circuit of the washing device 8 and have it actuated again in order to finish washing of the recovery container 5**. A new and final blow of compressed air will then be applied.

After completing this second washing operation, an ink of a different color can be introduced into the circuit for the inking elements without having the risk of having the ink soiled by ink residues of the previously-used color at that station.

Among other things, the use of the nozzle has the advantage of allowing a control of the quantity of washing fluid and to realize therewith a substantial saving in this washing fluid, which fact will provide for an appreciable ecological contribution when use is made of the washing device which has just been described.

Although various minor modifications may be suggested by those versed in the art, it should be understood that I wish to embody within the scope of the patent granted hereon all such modifications as reasonably and properly come within the scope of my contribution to the art.

I claim:

1. A device for washing inking elements of a rotary printing machine having an ink-transferring cylinder and various conduits for inking elements which are washed by pumping washing fluid through various conduits of the inking elements, said device comprising: an ink recovery container, a doctor blade chamber, two lateral side plates forming a sub-frame, a washing means mounted between said two lateral side plates of the sub-frame, a distributor provided with nozzles, a strap, said distributor being mounted for pivotable movement in said strap, means for shifting said strap laterally between the two side plates of the sub-frame with a movement to and fro along the inking element to be washed and means being provided at each end of travel of said strap to change the angle of orientation of the nozzles when approaching the end of travel in each direction.

2. A device according to claim 1, wherein the means for shifting the strap includes a pneumatic cylinder mounted between the two side plates of the sub-frame.

3. A device according to claim 1, wherein the angular position of the distributor is reversed each time the strap reaches the end of a stroke by a simple contact of the nozzles with a stop mounted in the sub-frame.

4. A device according to claim 1, wherein the lateral side plates and the subframe are shiftable from a first position to a second position by a pneumatic jack which is arranged outside of the sub-frame and extends between the sub-frame and the frame of the printing machine.

5. A device according to claim 1, which includes a lever, the doctor blade chamber being mounted by said lever, said lever being pivotably mounted on an axle so that the doctor blade chamber can be moved from a printing position adjacent an ink-transferring cylinder to a washing position removed from said cylinder.

* * * * *